US008120274B2

(12) United States Patent
Kuo et al.

(10) Patent No.: US 8,120,274 B2
(45) Date of Patent: Feb. 21, 2012

(54) CONTROLLING CIRCUIT FOR A LIGHT EMITTING DEVICE

(75) Inventors: Chih-Yuan Kuo, Taipei County (TW); Hsu-Min Chen, Hsinchu (TW)

(73) Assignee: ITE Tech. Inc., Hsinchu (TW)

( * ) Notice: Subject to any disclaimer, the term of this patent is extended or adjusted under 35 U.S.C. 154(b) by 425 days.

(21) Appl. No.: 12/411,402

(22) Filed: Mar. 26, 2009

(65) Prior Publication Data

US 2010/0181941 A1 Jul. 22, 2010

(30) Foreign Application Priority Data

Jan. 22, 2009 (TW) ..... 98102576 A

(51) Int. Cl.
*H05B 37/02* (2006.01)
*H05B 37/00* (2006.01)

(52) U.S. Cl. ..... 315/291; 315/185 R; 315/320; 315/192; 315/294; 315/217

(58) Field of Classification Search ..... 315/185 R, 315/192, 194, 246, 247, 291, 320, 360
See application file for complete search history.

(56) References Cited

U.S. PATENT DOCUMENTS

2008/0106216 A1* 5/2008 Yu et al. ..... 315/247
2009/0128045 A1* 5/2009 Szczeszynski et al. ... 315/185 R
2009/0261743 A1* 10/2009 Chen et al. ..... 315/192

* cited by examiner

*Primary Examiner* — Vibol Tan
(74) *Attorney, Agent, or Firm* — Jianq Chyun IP Office

(57) ABSTRACT

A controlling circuit and a controlling method are disclosed. The controlling circuit includes a plurality of switches and a comparator. The first terminals of the switches are respectively coupled to one of a plurality of LED channels. The switches are conducted according to a plurality of switching signals respectively, wherein the switching signals are asserted alternately. The first input terminal of the comparator is coupled to the second terminals of the switches and the second input terminal of the comparator receives a reference voltage for the comparator to compare the voltage of the first input terminal with the voltage of the second input terminal so as to output a comparison result. In this way, whether the LED channels work abnormally or not may be detected. In addition, the hardware cost may also be reduced by employing fewer comparators through a sharing mode.

9 Claims, 15 Drawing Sheets

CONTROLLING CIRCUIT FOR A LIGHT EMITTING DEVICE

CROSS-REFERENCE TO RELATED APPLICATION

This application claims the priority benefit of Taiwan application serial no. 98102576, filed on Jan. 22, 2009. The entirety of the above-mentioned patent application is hereby incorporated by reference herein and made a part of specification.

BACKGROUND OF THE INVENTION

1. Field of the Invention

The present invention generally relates to a control technology, and more particularly, to a control technology of light emitting diode channels (LED channels).

2. Description of Related Art

Along with the upgrowth of the semiconductor industry and the related electronic industry, many digital means, such as mobile phone, digital camera, digital video camera, notebook and desktop computer, have been getting continuous evolutions and improvements towards more usage convenience, multi functions and stylish design. In order to use the information products, a displaying screen is an indispensable man-machine interface, by which a user can more conveniently manipulate the above-mentioned apparatuses. Among various displaying screens, the liquid crystal display (LED) has played a major role in the market. However, an LED is not self-luminescent, so that a backlight module must be employed and placed under the LED, which serves as a light source so as to make display possible.

FIG. 1 is a diagram of a conventional backlight module and a controlling circuit thereof. Referring to FIG. 1, a conventional backlight module usually comprises a plurality of LED channels 21-2*x*, wherein the LED channels 21-2*x* are respectively connected in series to a plurality of current sources 31-3X and the connected current sources 31-3X can respectively control the currents flowing the LED channels 21-2*x*. The circuit for detecting short-circuit/open-circuit 10 in FIG. 1 can detect a plurality of voltages Ch1-Chx so as to judge whether or not the LED channels 21-2*x* are short or open.

FIG. 2 is a diagram of the circuit for detecting short-circuit/open-circuit in FIG. 1. Referring to FIGS. 1 and 2, a comparator 41 compares the voltage Ch1 with a voltage Vref_short. When the voltage Ch1 is higher than the voltage Vref_short, the comparator 41 outputs a signal short to indicate the LED channel 21 is short already. Analogically for the comparators 42-4*x*, the signal short output from an OR gate 61 is for indicating one of the LED channels 21-2*x* has short-circuit.

On the other hand, a comparator 51 compares the voltage Ch1 with a voltage Vref_open. When the voltage Ch1 is lower than the voltage Vref_open, the comparator 51 outputs a signal short to indicate the LED channel 21 is open already. Analogically for the comparators 52-5*x*, the signal open output from an OR gate 62 is for indicating one of the LED channels 21-2*x* has open-circuit.

It should be noted that in the prior art, the quantity of the comparators is increased with the increasing quantity of the LED channels. However, since the comparators 42-4*x* and the comparators 52-5*x* are analog circuits, so that the circuit area thereof is considerably large with the increasing quantity thereof. In addition, the hardware cost would accordingly soars, which is disadvantageous for the circuit layout.

SUMMARY OF THE INVENTION

Accordingly, the present invention is directed to a controlling apparatus, which is capable of detecting whether or not any one of the employed LED channels works abnormally and reducing the demand on the comparators.

The present invention is also directed to a controlling method, which is capable of detecting whether or not any one of the employed LED channels works normally and reducing the demand on the comparators so as to lower down the hardware cost.

The present invention provides a controlling circuit, which includes a plurality of first switches and a comparator. The first terminals of the first switches are respectively coupled to one of a plurality of LED channels. The first switches are conducted according to a plurality of first switching signals respectively, wherein the first switching signals are asserted alternately. The first input terminal of the comparator is coupled to the second terminals of the first switches and the second input terminal of the comparator receives a reference voltage for comparing the voltage of the first input terminal with the voltage of the second input terminal so as to output a comparison result.

In an embodiment of the present invention, the above-mentioned, the controlling circuit further includes a signal generator, which is coupled to every of the first switches for generating the corresponding first switching signals. In more details, the signal generator includes an NOR gate and a flip-flop string. The NOR gate receives every of the first switching signals to generate a trigger signal. The flip-flop string receives the trigger signal to generates every of the first switching signals.

In an embodiment of the present invention, the controlling circuit includes a logic circuit. The logic circuit includes a flip-flop string, wherein the flip-flop string includes a plurality of flip-flops. The input terminal of each of the flip-flops receives the comparison result. The flip-flops respectively receive the first switching signals to generate a plurality of indication signals respectively, wherein the first switching signal serves as a clock signal of the corresponding flip-flop. In another embodiment, the logic circuit further includes an OR gate, and the OR gate receives the indication signals so as to generate an output signal.

In an embodiment of the present invention, the controlling circuit further includes an alert device coupled to the comparator. The alert device decides whether or not to send out an alert according to the comparison result. In another embodiment, the controlling circuit further includes a reference voltage generator, an error amplifier, a power supply, a voltage-dividing circuit and a voltage-regulating capacitor. The reference voltage generator is coupled to the comparator and outputs a second reference voltage according to the comparison, result. The error amplifier is coupled to the reference voltage generator and receives a second reference voltage and a dividing voltage so as to output an adjusting signal. The power supply is coupled to the error amplifier and all the LED channels, adjusts a supply voltage according to the adjusting signal and outputs the supply voltage to all the LED channels. The voltage-dividing circuit is coupled to the power supply and the error amplifier and generates the dividing voltage according to the supply voltage. The voltage-regulating capacitor is coupled to the power supply to stabilize the voltage.

In an embodiment of the present invention, the controlling circuit further includes a plurality of second switches. The first terminal for each of the second switches are respectively coupled to one of a plurality of voltages, and the second terminals of the second switches are coupled to the second input terminal of the comparator. The second switches are conducted according to a plurality of second switching signals respectively so as to select one of the voltages as the first reference voltage, wherein the second switching signals are asserted alternately.

In an embodiment of the present invention, the controlling circuit further includes a plurality of current sources. The current sources respectively connect in series one of the LED channels and respectively control the current flow each of the LED channels according to one of a plurality of light-adjusting signals.

In an embodiment of the present invention, the controlling circuit further includes a signal generator, which includes a first NOR gate, a second NOR gate, a third NOR gate, a first flip-flop string, a second flip-flop string, a plurality of AND gates, an inverter, a flip-flop and an OR gate. The first NOR gate receives a plurality of filtering signals to generate a trigger signal. The first flip-flop string receives the trigger signal to generate the filtering signals. The second flip-flop string receives a reference light-adjusting signal to generate all the light-adjusting signals. The first terminals of the AND gates respectively receive one of the filtering signals, and the second terminals of the AND gates respectively receive a corresponding light-adjusting signal so as to generate each of the first switching signals. The inverter receives a first filtering signal in the filtering signals. The first input terminal of the second NOR gate receives a first light-adjusting signal in the light-adjusting signals and the second input terminal of the second NOR gate is coupled to the output terminal of the inverter. The input terminal of the flip-flop is coupled to the output terminal of the second NOR gate. The third NOR gate receives the light-adjusting signals. The first input terminal and the second input terminal of the OR gate are respectively coupled to the output terminal of the flip-flop and the output terminal of the third NOR gate so as to output a reset signal to the first flip-flop string.

The present invention further provides a controlling method, which includes generating a plurality of signals, wherein the signals are asserted alternately and using a timing of the signals so as to monitor a voltage at a terminal of each of a plurality of LED channels respectively.

In an embodiment of the present invention, the step of using a timing of the signalsso as to monitor a voltage at a terminal of each of a plurality of LED channels respectively includes receiving the voltage at a terminal of one of the LED channels as a stand-by voltage according to the timing of the signals and comparing the stand-by voltage with a reference voltage so as to obtain a comparison result.

In an embodiment of the present invention, the step of generating the signals includes progressively delaying a reference signal so as to generate the signals.

Based on the described above, the present invention takes a novel scheme that generating a plurality of signals and respectively monitoring the voltage at a terminal of one of a plurality of LED channels according to the timing of the signals, wherein the signals are asserted alternately, so that the present invention is advantageous not only in monitoring whether or not the LED channels work abnormally, but also in reducing the hardware cost.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
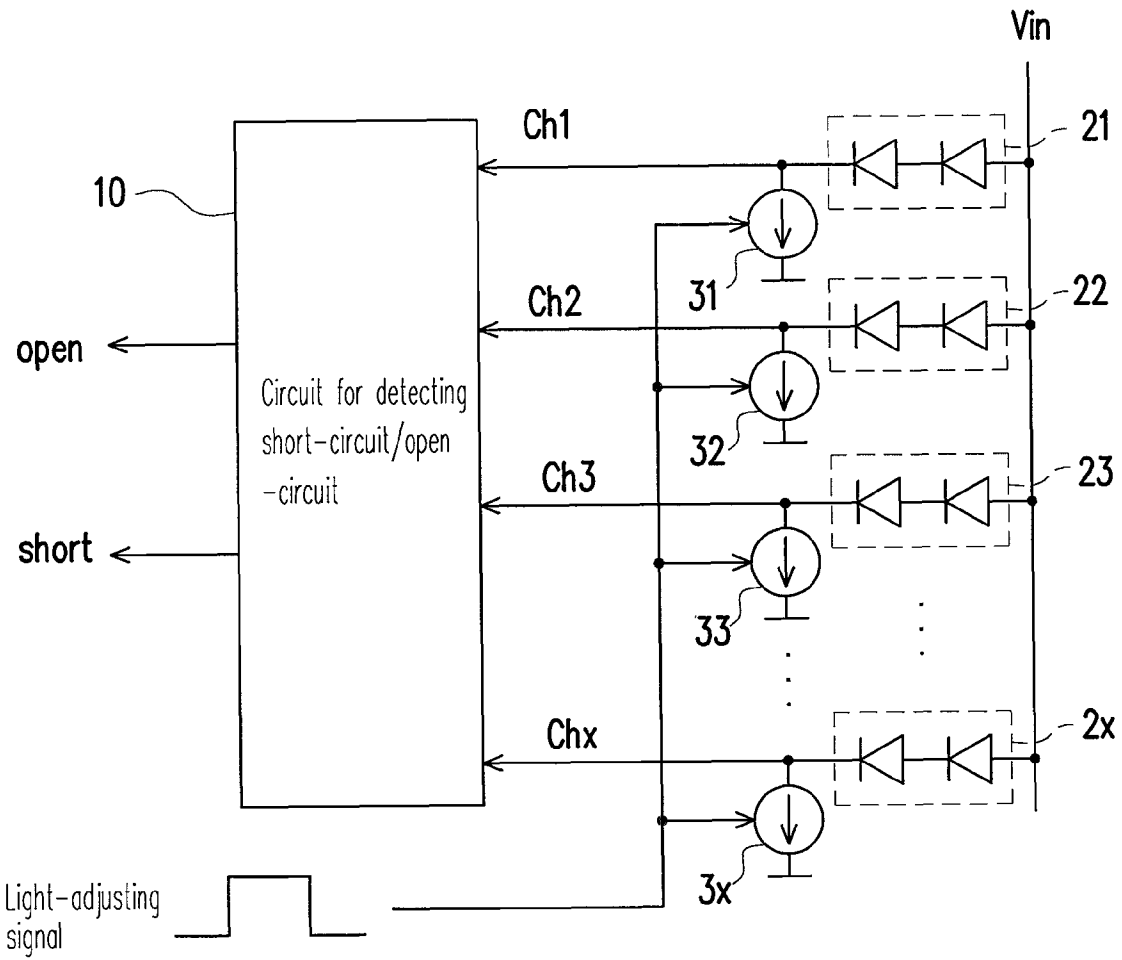
FIG. 1 (PRIOR ART)
FIG. 1 is a diagram of a conventional backlight module and a controlling circuit thereof.
Figure 2:
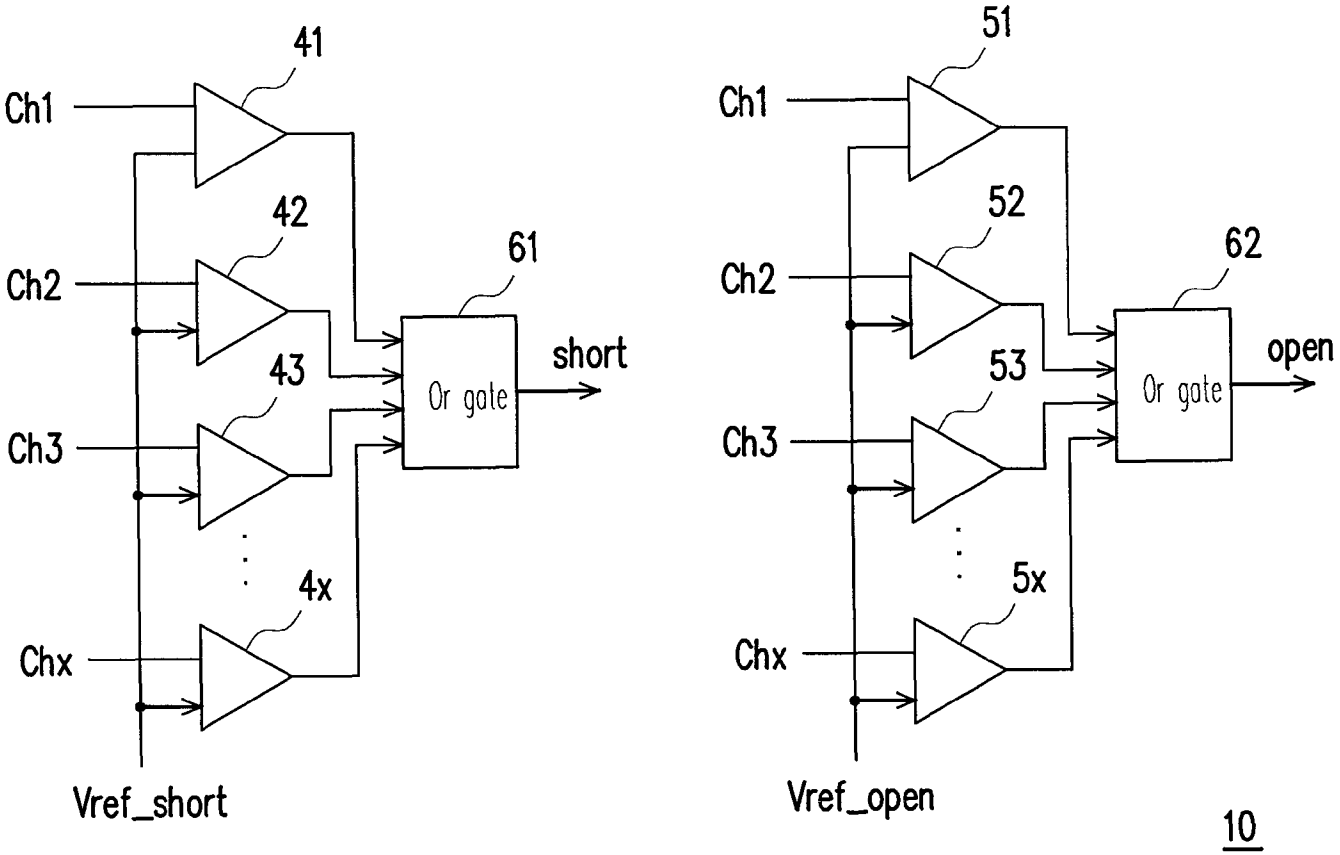
FIG. 2 (PRIOR ART)
FIG. 2 is a diagram of the circuit for detecting short-circuit/open-circuit in FIG. 1.

A controlling circuit of a conventional backlight module requires a number of comparators, which occupies a great circuit area, but also cost more. To avoid the disadvantage in the prior art, the embodiments of the present invention make a plurality of switches coupled to the first input terminal of a comparator, wherein the switches are turned on alternately, so that the voltages at a terminal of every of a plurality of LED channels is alternately input to the first input terminal of the comparator. The second input terminal of the comparator receives a reference voltage, and then the comparator compares the voltage of the first input terminal with the voltage of the second input terminal so as to output a comparison result. In this way, the embodiments of the present invention may detect whether or not the LED channels work abnormally by means of the comparison result. The embodiments of the present invention are also advantageous in effectively reducing the quantity of the employed comparators. Reference will now be made in detail to the present embodiments of the invention, examples of which are illustrated in the accompanying drawings. Wherever possible, the same reference numbers are used in the drawings and the description to refer to the same or like parts.

Figure 3A:
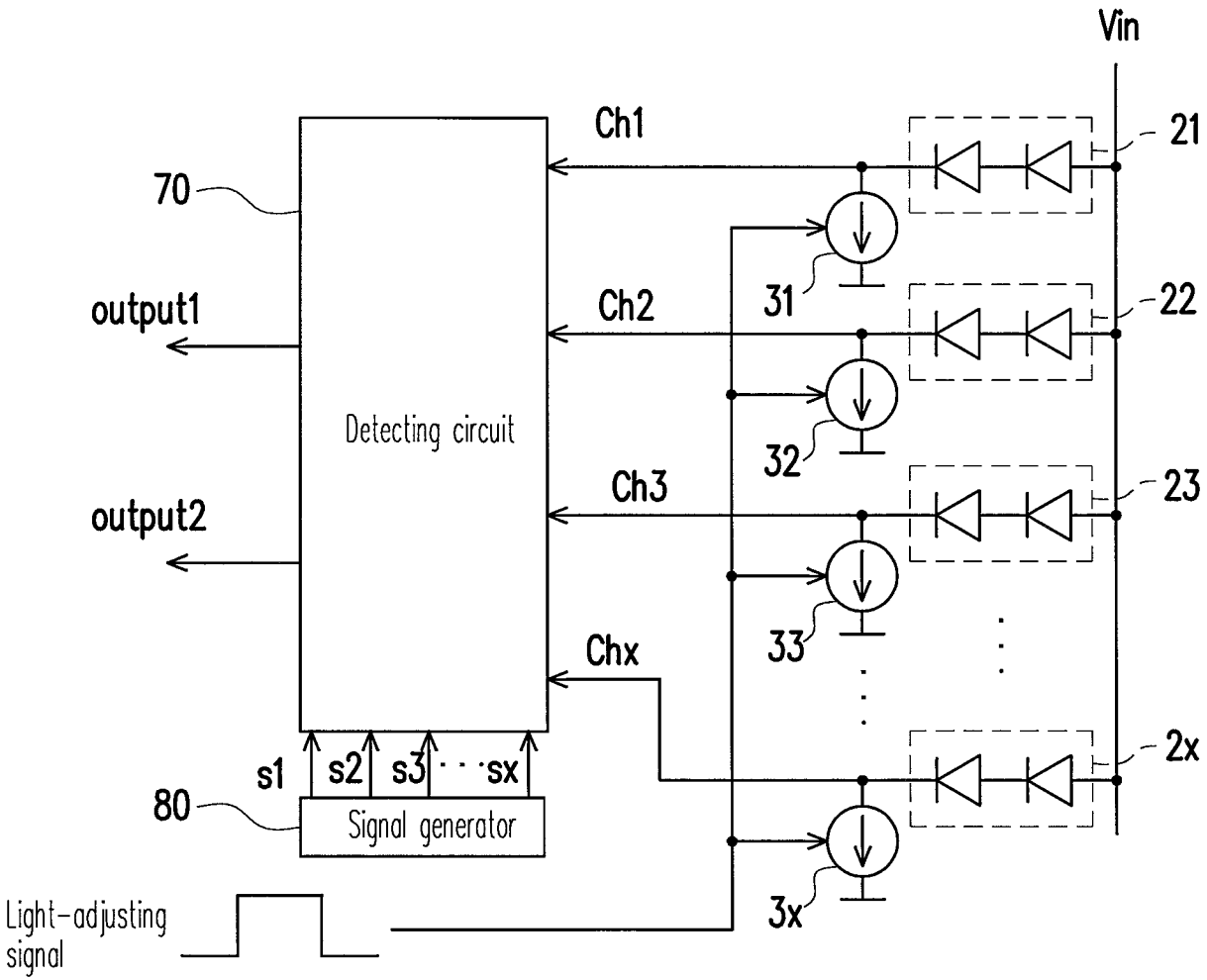
FIG. 3A is a diagram of a controlling circuit according to the first embodiment of the present invention.
Figure 3B:
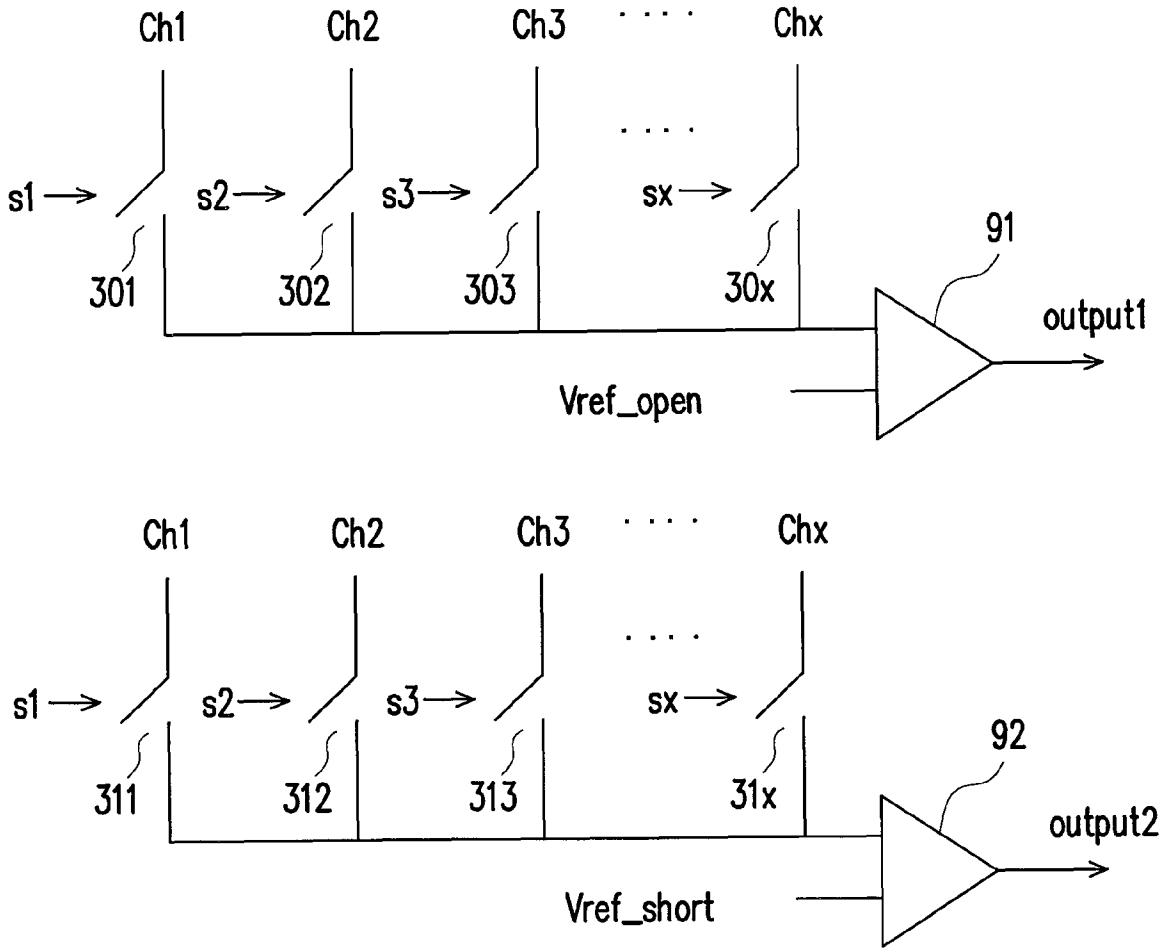
FIG. 3B is a diagram of the detecting circuit in FIG. 3A.

FIG. 3A is a diagram of a controlling circuit according to the first embodiment of the present invention and FIG. 3B is a diagram of the detecting circuit in FIG. 3A. Referring to FIGS. 3A and 3B, the controlling circuit may include a detecting circuit 70, or further include a signal generator 80 and a plurality of current sources 31-3*x*. In the embodiment, the detecting circuit 70 includes a plurality of switches 301-30*x* and switches 311-31*x* and two comparators 91 and 92. A plurality of LED channels 21-2*x* in the controlling circuit respectively include a plurality of LEDs. Although in FIG. 3A, only two LEDs are shown, but the present invention is not limited to two LEDs. In other embodiments, the LED channels 21-2$x$ may be respectively composed of LEDs of different numbers and the LEDs are connected in parallel or in series.

The anodes of the LED channels 21-2$x$ receive a voltage Vin and the cathodes thereof are respectively coupled to the current sources 31-3X. The currents flowing the current sources 31-3X may be controlled according to a light-adjusting signal, so that the luminance of the LED channels 21-2$x$ may be adjusted. The detecting circuit 70 is coupled to the cathodes of the LED channels 21-2$x$ for detecting the voltages Ch1-Chx of the LED channels 21-2$x$.

The first terminals of the switches 301-30$x$ may respectively receive the voltages Ch1-Chx and the second terminals thereof are coupled to the first input terminal of the comparator 91. The switches 301-30$x$ are turned on according to the switching signals s1-$sx$ respectively. The second input terminal of the comparator 91 receives a voltage Vref_open. The comparator 91 compares the voltage of the first input terminal with the voltage of the second input terminal thereof so as to output a comparison result ouput1 to indicate whether or not one of the LED channels 21-2$x$ has open-circuit. In more details, when the voltage of the first input terminal of the comparator 91 is lower than the voltage Vref_open, it means one of LED channels 21-2$x$ may be open.

Analogically for the rest, the first terminals of the switches 311-31$x$ respectively receive the voltages Ch1-Chx, and the second terminals of the switches 311-31$x$ are coupled to the first input terminal of the comparator 92. The switches 311-31$x$ are turned on according to the switching signals s1-$sx$ respectively. The second input terminal of the comparator 92 receives a voltage Vref_short. The comparator 92 compares the voltage of the first input terminal with the voltage of the second input terminal thereof so as to output a comparison result ouput2 to indicate whether or not one of the LED channels 21-2$x$ has short-circuit. In more details, when the voltage of the first input terminal of the comparator 92 is higher than the voltage Vref_short, it means one of LED channels 21-2$x$ may be short.

Figure 4:
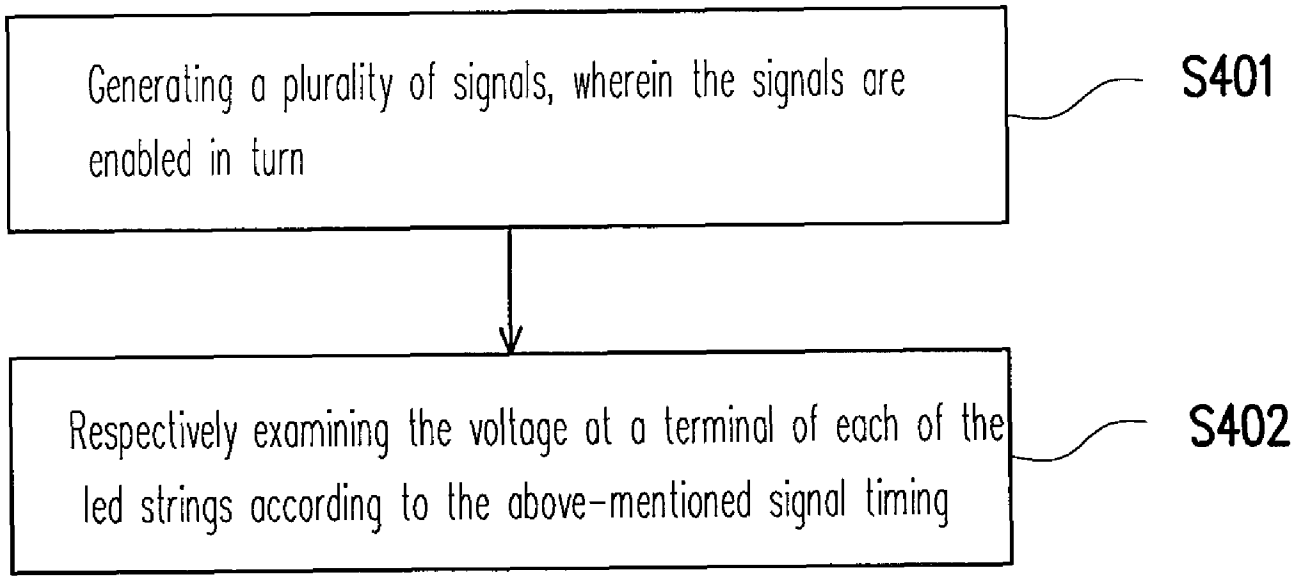
FIG. 4 is a flowchart of a controlling method according to the first embodiment of the present invention.
Figure 5:
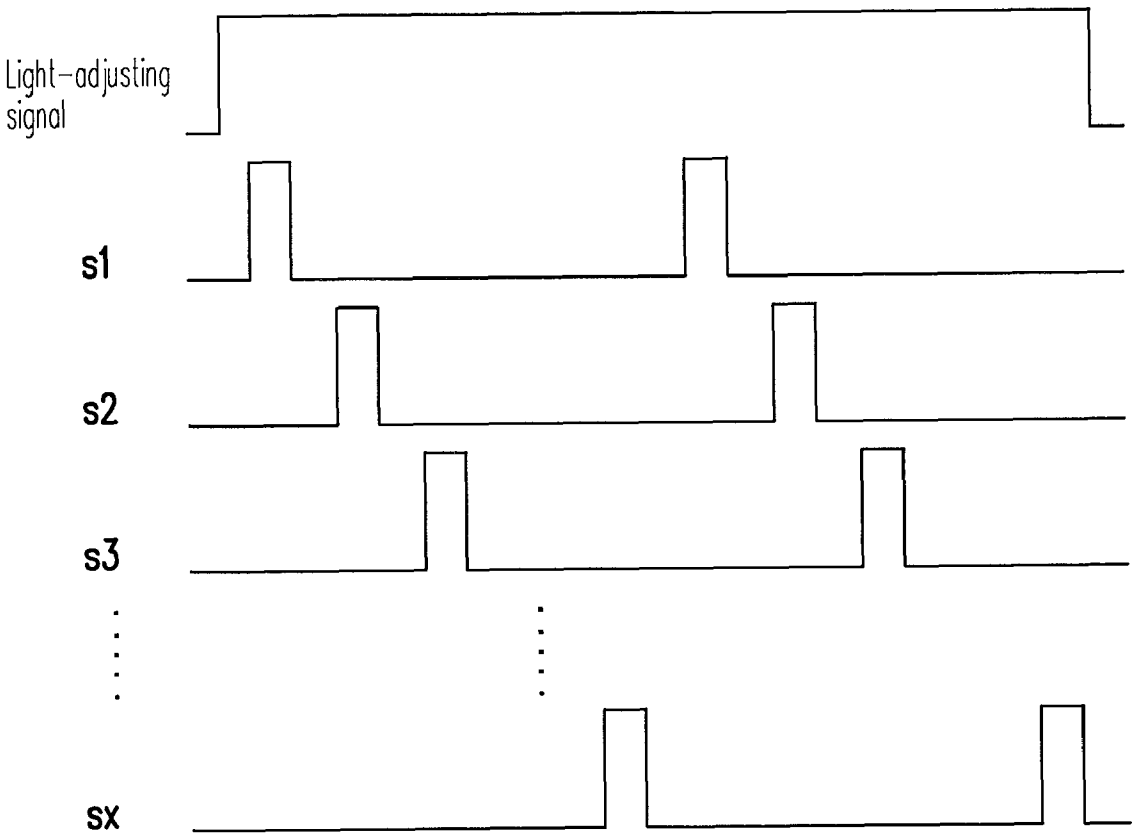
FIG. 5 is a diagram showing the timing of a light-adjusting signal and a plurality of switching signals according to the first embodiment of the present invention.

FIG. 4 is a flowchart of a controlling method according to the first embodiment of the present invention and FIG. 5 is a diagram showing the timing of a light-adjusting signal and a plurality of switching signals according to the first embodiment of the present invention. First in step S401, a plurality of signals are generated, wherein the signal are asserted alternately. For example, the signal generator 80 may generate the switching signals s1-$sx$, which are asserted alternately. It should be noted that when the light-adjusting signal is asserted, the misjudgement risk by the detecting circuit 70 may be reduced by alternately enabling the switching signals s1-$sx$. In the following, an implementation of the signal generator is described for anyone skilled in the art as a reference.

Figure 6:
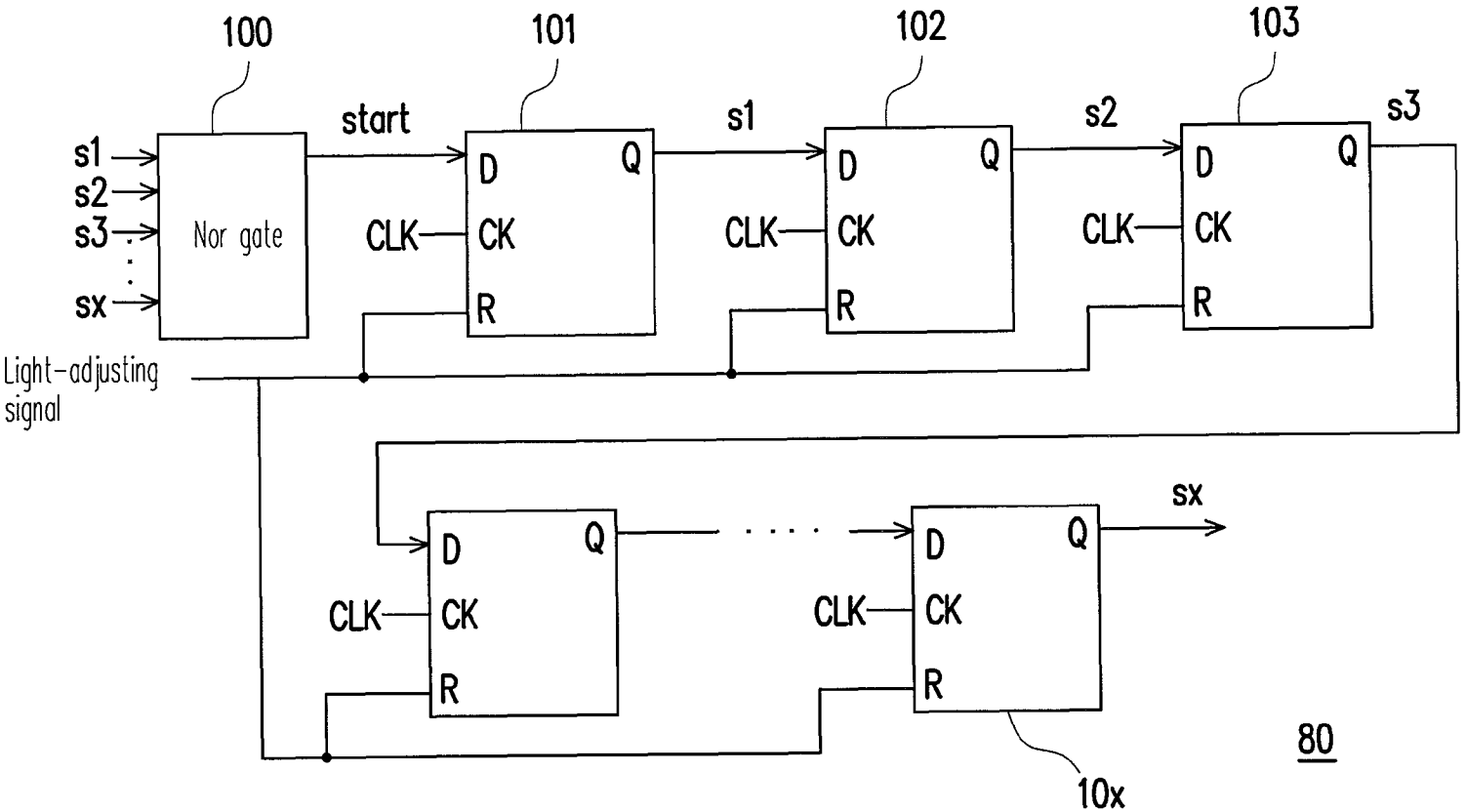
FIG. 6 is a circuit diagram of a signal generator according to the first embodiment of the present invention.

FIG. 6 is a circuit diagram of a signal generator according to the first embodiment of the present invention. A signal generator 80 in the embodiment includes an NOR gate 100 and a plurality of flip-flops 101-10$x$. The NOR gate 100 receives a plurality of switching signals s1-$sx$ so as to output a signal start. The flip-flop 101 outputs the switching signal s1 according to a clock signal clk and the signal start. The flip-flop 102 outputs the switching signal s2 according to the clock signal clk and the switching signal s1. Analogically for the flip-flops 103-10$x$, which are omitted to describe. In addition, the flip-flops 101-10$x$ may be reset according to the light-adjusting signal. By the above-mentioned scheme, the embodiments of the present invention may ensure to alternately enable the switching signals s1-$sx$ under the condition of enabling the light-adjusting signal, which is advantageous in reducing a misjudgement risk by the detecting circuit 70.

Next in step S402, a timing of the signals is used so as to monitor a voltage at a terminal of each of the LED channels respectively. For example, when the signal s1 is asserted and the switching signals s2-$sx$ are deasserted, the switch 301 is turned on and the switches 302-30$x$ are turned off, so that the first input terminal of the comparator 91 receives the voltage Ch1 at the cathode terminal of the LED channel 21. Meanwhile, the comparator 91 compares the voltage Ch1 with the reference voltage Vref_open so as to output the comparison result ouput1.

It should be noted that when the LED channel 21 is open, the equivalent resistance of the LED channel 21 is near to infinity, so that the voltage Ch1 approaches a ground voltage. Based on the above [mentioned consideration, anyone skilled in the art should appropriately define the reference voltage Vref_open, so that when the voltage Ch1 is lower than the reference voltage Vref_open, the comparison result ouput1 is able to indicate the LED channel 21 may be open. In addition, anyone skilled in the art may also dispose an alert device (not shown), for example, a light alert device or a sound alert device, and the alert device is coupled to the comparator 91 to send out an alert according to the comparison result ouput1.

When the signal s2 is asserted and the switching signals s1 and s3-$sx$ are deasserted, the switch 302 is turned on and the switches 301 and 303-30$x$ are turned off, so that the first input terminal of the comparator 91 receives the voltage Ch2 at the cathode terminal of the LED channel 22. Meanwhile, the comparator 91 compares the voltage Ch2 with the reference voltage Vref_open so as to output the comparison result ouput1. At the time, the comparison result ouput1 is able to indicate whether or not the LED channel 22 may be open. Analogically for indicating whether or not the LED channels 23-2$x$ are open, which is omitted to describe.

On the other hand, when the signal s1 is asserted and the switching signals s2-$sx$ are deasserted, the switch 311 is turned on and the switches 312-31$x$ are turned off, so that the first input terminal of the comparator 92 receives the voltage Ch1 at the cathode terminal of the LED channel 21. Meanwhile, the comparator 92 compares the voltage Ch1 with the reference voltage Vref_short so as to output the comparison result ouput2.

When the LED channel 21 has short-circuit, the equivalent resistance of the LED channel 21 drops down; therefore, anyone skilled in the art should appropriately define the reference voltage Vref_short, so that when the voltage Ch1 is higher than the reference voltage Vref_short, the comparison result ouput2 is able to indicate the LED channel 21 may be open. In addition, anyone skilled in the art may also dispose an alert device (not shown), for example, a light alert device or a sound alert device, and the alert device is coupled to the comparator 92 to send out an alert according to the comparison result ouput2.

When the signal s2 is asserted and the switching signals s1 and s3-$sx$ are deasserted, the switch 312 is turned on and the switches 311 and 313-31$x$ are turned off, so that the first input terminal of the comparator 92 receives the voltage Ch2 at the cathode terminal of the LED channel 22. Meanwhile, the comparator 92 compares the voltage Ch2 with the reference voltage Vref_short so as to output the comparison result ouput2. At the time, the comparison result ouput2 is able to indicate whether or not the LED channel 22 may be short. Analogically for indicating whether or not the LED channels 23-2$x$ are short, which is omitted to describe.

Based on the described above, the controlling circuit of the embodiment may detect whether or not the LED channels 21-2$x$ are short or open. In addition, the embodiment employs two comparators (91 and 92) only. In particular, the quantity of the comparators is not increased with an increasing quantity of the LED channels, which may effectively reduce the circuit area and save the hardware cost.

Although the above-mentioned embodiment provides an implementation of the controlling circuit and the controlling method, but anyone skilled in the art should understand the relevant manufactures have their own designs of the controlling circuit and the controlling method. Therefore, the present invention is not limited to the above-mentioned implementation. In fact, whenever the voltage at a terminal of each of a plurality of LED channels is respectively monitored according to the timing of a plurality of signals which are asserted alternately, the scheme is counted to fall in the scope of the present invention. More embodiments of the present invention are described hereinafter for anyone skilled in the art to further understand the spirit of the present invention and to realize the present invention.

Figure 7A:
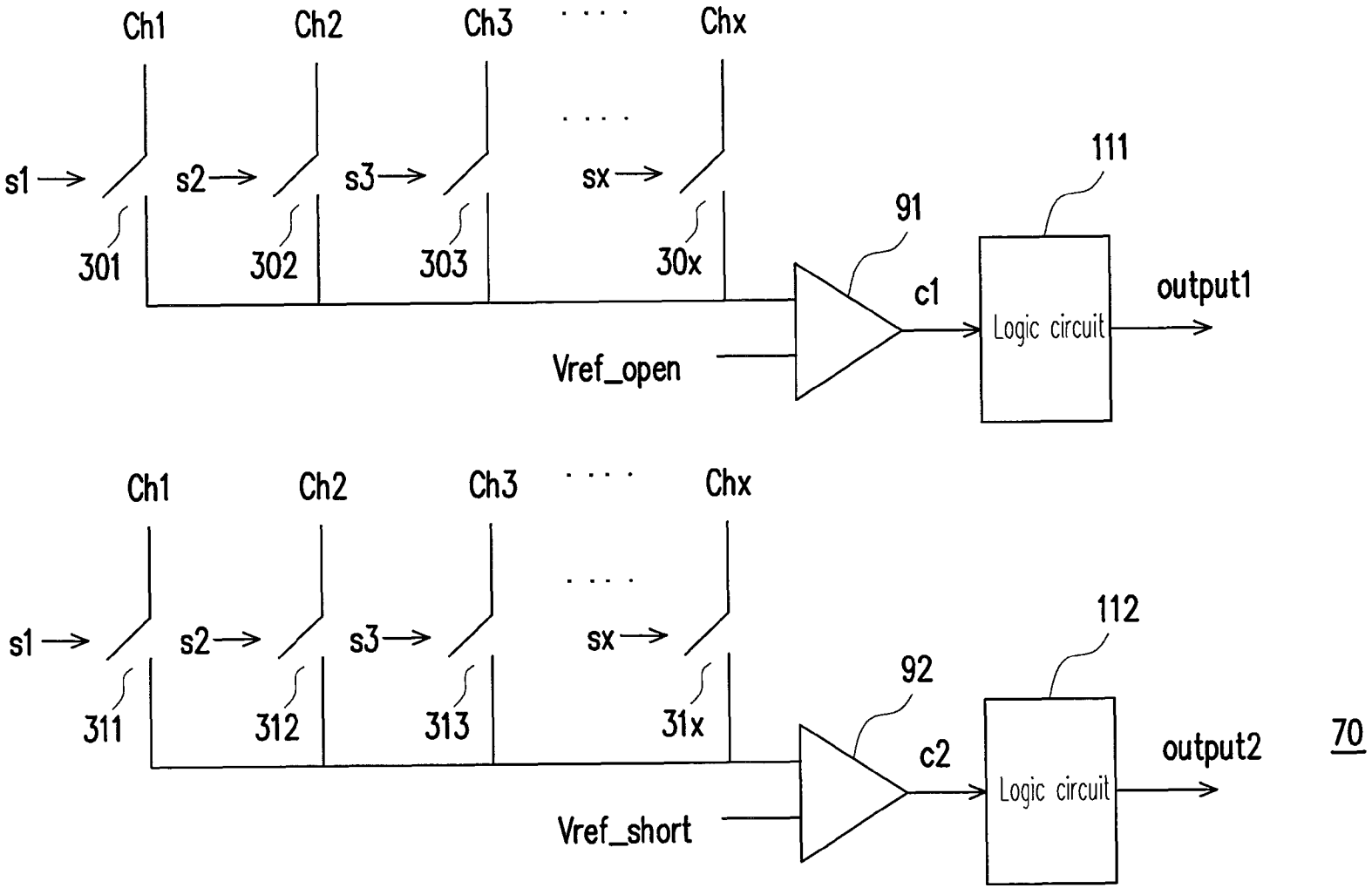
FIG. 7A is a diagram of another detecting circuit.

FIG. 3B in the above-mentioned embodiment is one of the implementations only, which the present invention is not limited to. The implementation or the architecture of the detecting circuit may vary depending on the requirement. For example, FIG. 7A is a diagram of another detecting circuit. FIG. 7A is similar to FIG. 3B, except that two additional logic circuits 111 and 112 are disposed in FIG. 7A. The logic circuits 111 and 112 respectively analyze the signals c1 and c2 output from the comparators 91 and 92, so as to judge whether or not each of the LED channels 21-2*x*) works abnormally in association with the timing of the switching signals s1-*sx*. The logic circuits 111 and 112 are similar to each other. In the following, the logic circuit 111 is depicted, and anyone skilled in the art may easily and similarly implement the logic circuit 112.

Figure 7B:
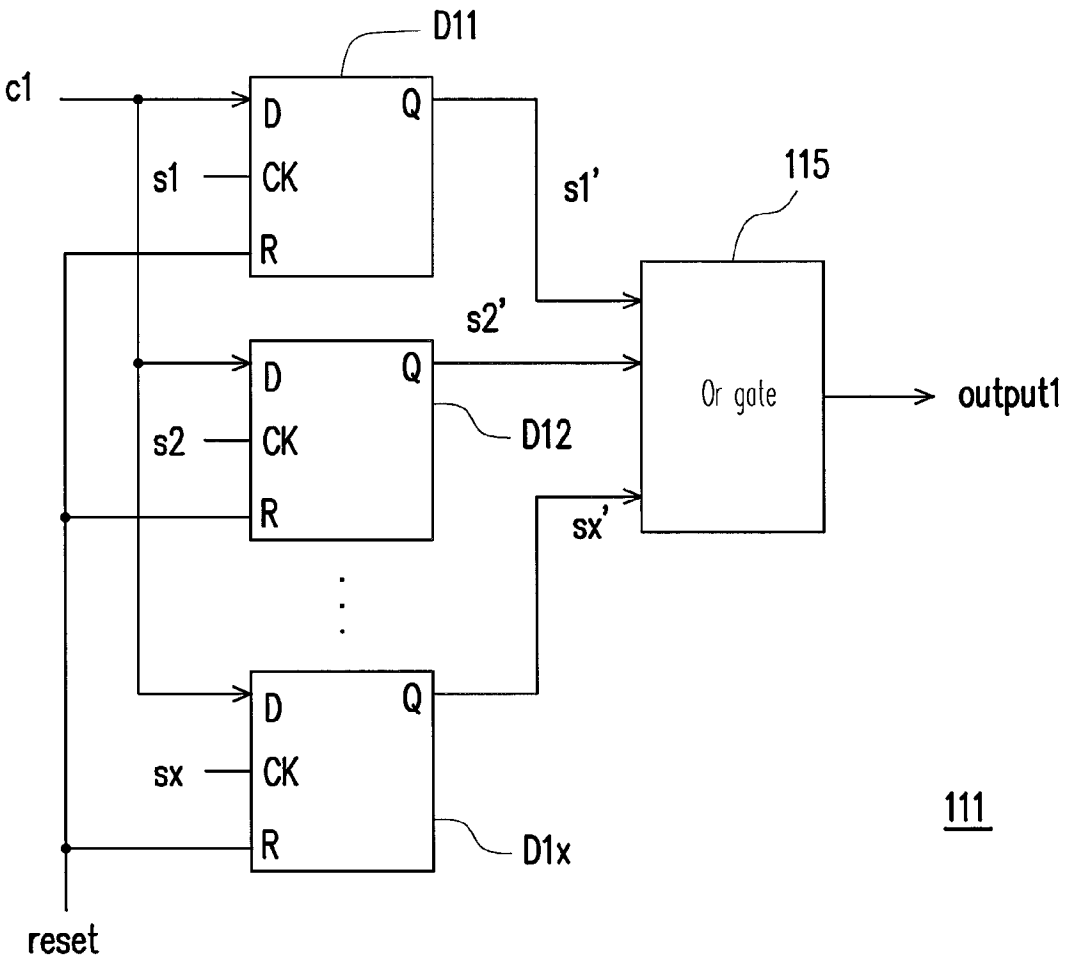
FIG. 7B is a diagram of the logic circuit in FIG. 7A.

FIG. 7B is a diagram of the logic circuit in FIG. 7A. The logic circuit 111 includes a plurality of flip-flops D11-D1*x* and an OR gate 115. The flip-flops D11-D1*x* may be reset according to a reset signal. The flip-flops D11-D1*x* respectively receive the switching signals s1-*sx* serving as the clock signals. The flip-flops D11-D1*x* also receive the signal c1, so as to respectively output signals s1'-*sx*' in association with the clock signals s1-*sx*. The OR gate 115 receives the signals s1'-*sx*′ so as to output the signal ouput1. The signals s1'-*sx*′ are for respectively indicating whether or not the LED channels 21-2*x* are open; the signal ouput1 is for indicating whether or not one of the LED channels 21-2*x* is open. In this way, the function of the above-mentioned embodiment is also achieved.

Figure 8A:
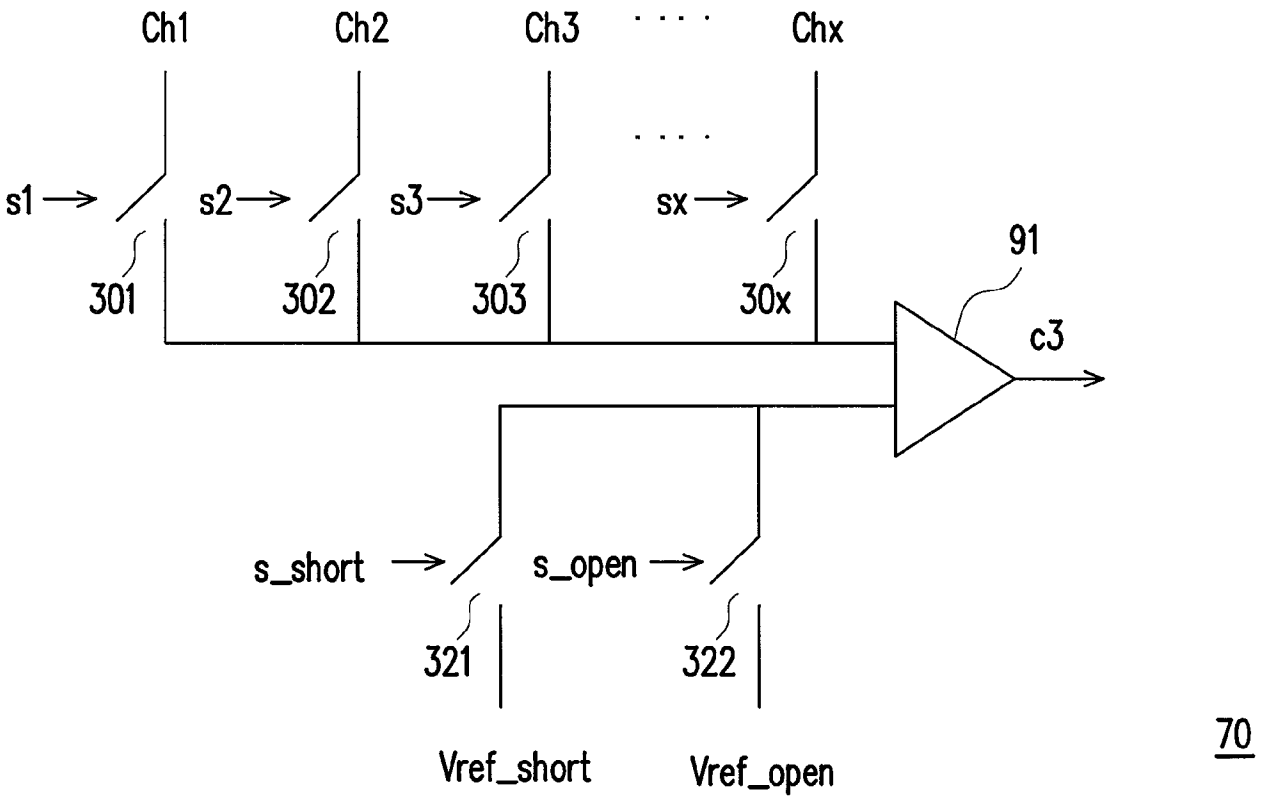
FIG. 8A is diagram of yet another detecting circuit and FIG. 8B is a diagram showing the timing of a light-adjusting signal and a plurality of switching signals.
Figure 8B:
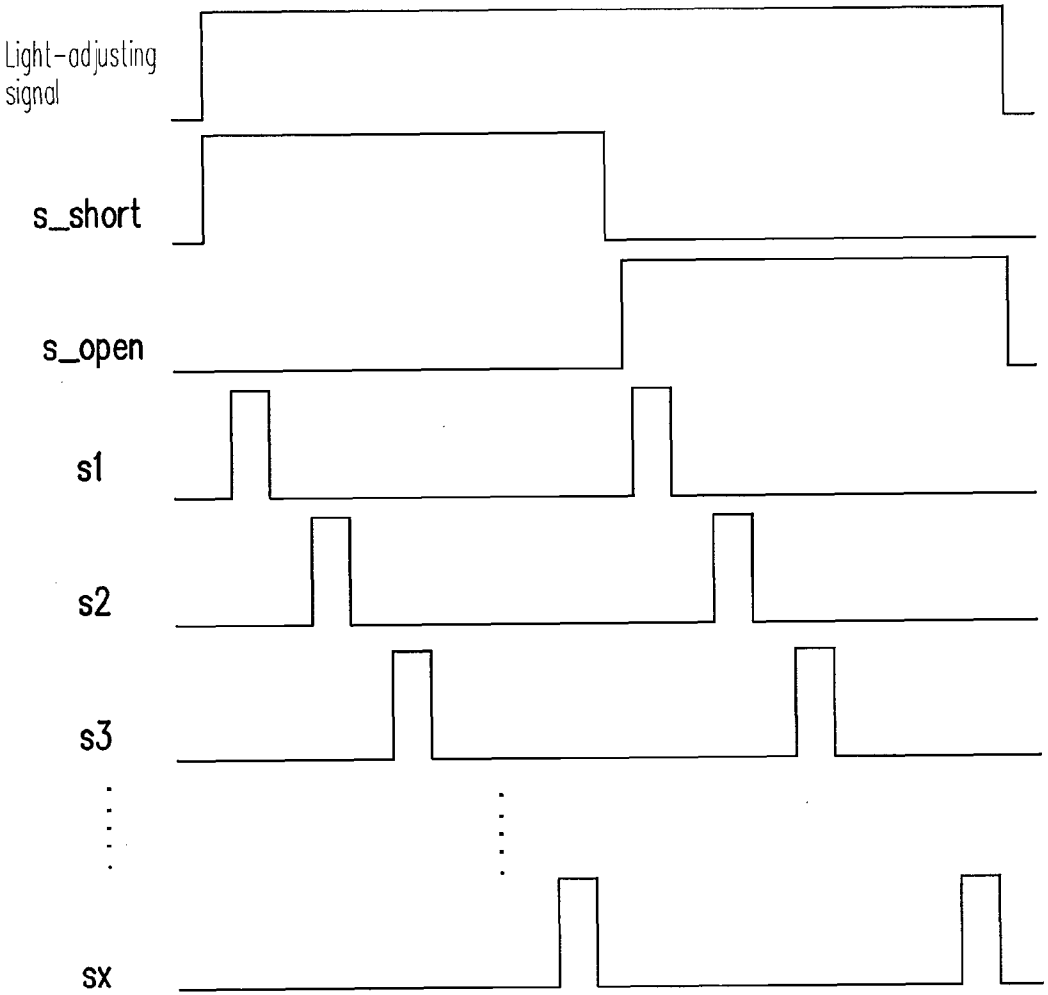

FIG. 8A is diagram of yet another detecting circuit and FIG. 8B is a diagram showing the timing of a light-adjusting signal and a plurality of switching signals. FIG. 8A is similar to FIG. 3B, except that two switches 321 and 322 rather than the switches 311-31*x* and the comparator 92 in FIG. 3B are employed in FIG. 8A. The switch 321 is coupled between the reference voltage Vref_short and the second input terminal of the comparator 91; the switch 322 is coupled between the reference voltage Vref_open and the second input terminal of the comparator 91. The switches 321 and 322 are conducted according to two switching signals s_short and s_open respectively. When the switching signal s_short is asserted and the switching signal s_open is deasserted, the second input terminal of the comparator 91 receives the reference voltage Vref_short; when the switching signal s_open is asserted and the switching signal s_short is deasserted, the second input terminal of the comparator 91 receives the reference voltage Vref_open.

In more details, when the switching signals s1 and s_open are asserted and the switching signals s2-*sx* and s_short are deasserted, the signal c3 output from the comparator 91 may indicate whether or not the LED channel 21 is open; when the switching signals s1 and s_short are asserted and the switching signals s2-*sx* and s_open are deasserted, the signal c3 output from the comparator 91 may indicate whether or not the LED channel 21 is short. Analogically for the rest, when the switching signals s2 and s_open are asserted and the switching signals s1, s3-*sx* and s_short are deasserted, the signal c3 output from the comparator 91 may indicate whether or not the LED channel 22 is open; when the switching signals s2 and s_short are asserted and the switching signals s1, s3-*sx* and s_open are deasserted, the signal c3 output from the comparator 91 may indicate whether or not the LED channel 22 is short. In this way, not only the function of the first embodiment may be achieved, but also the embodiment may further reduce the circuit area and save the hardware cost.

Figure 9:
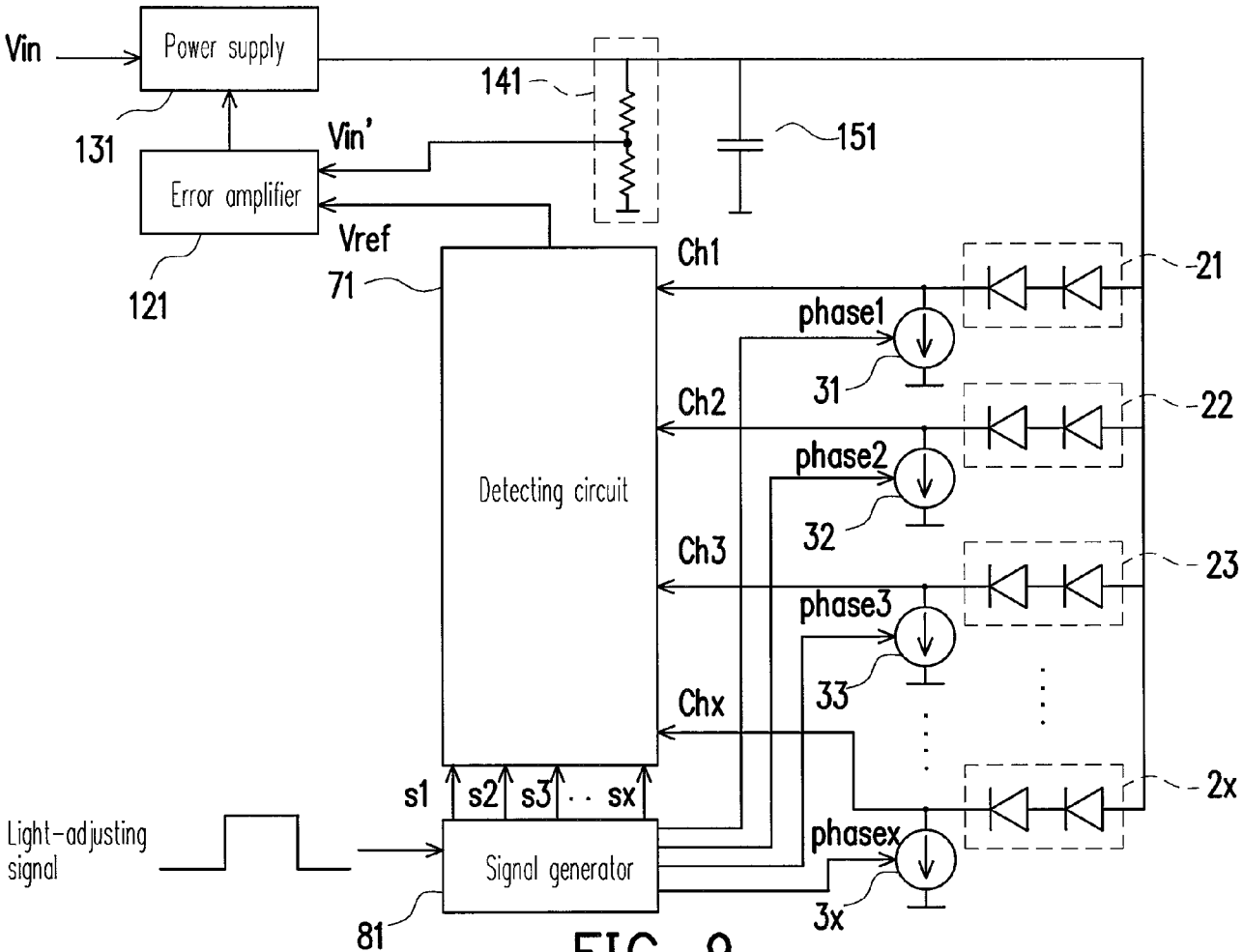
FIG. 9 is a diagram of a controlling circuit according to the second embodiment of the present invention.
Figure 10:
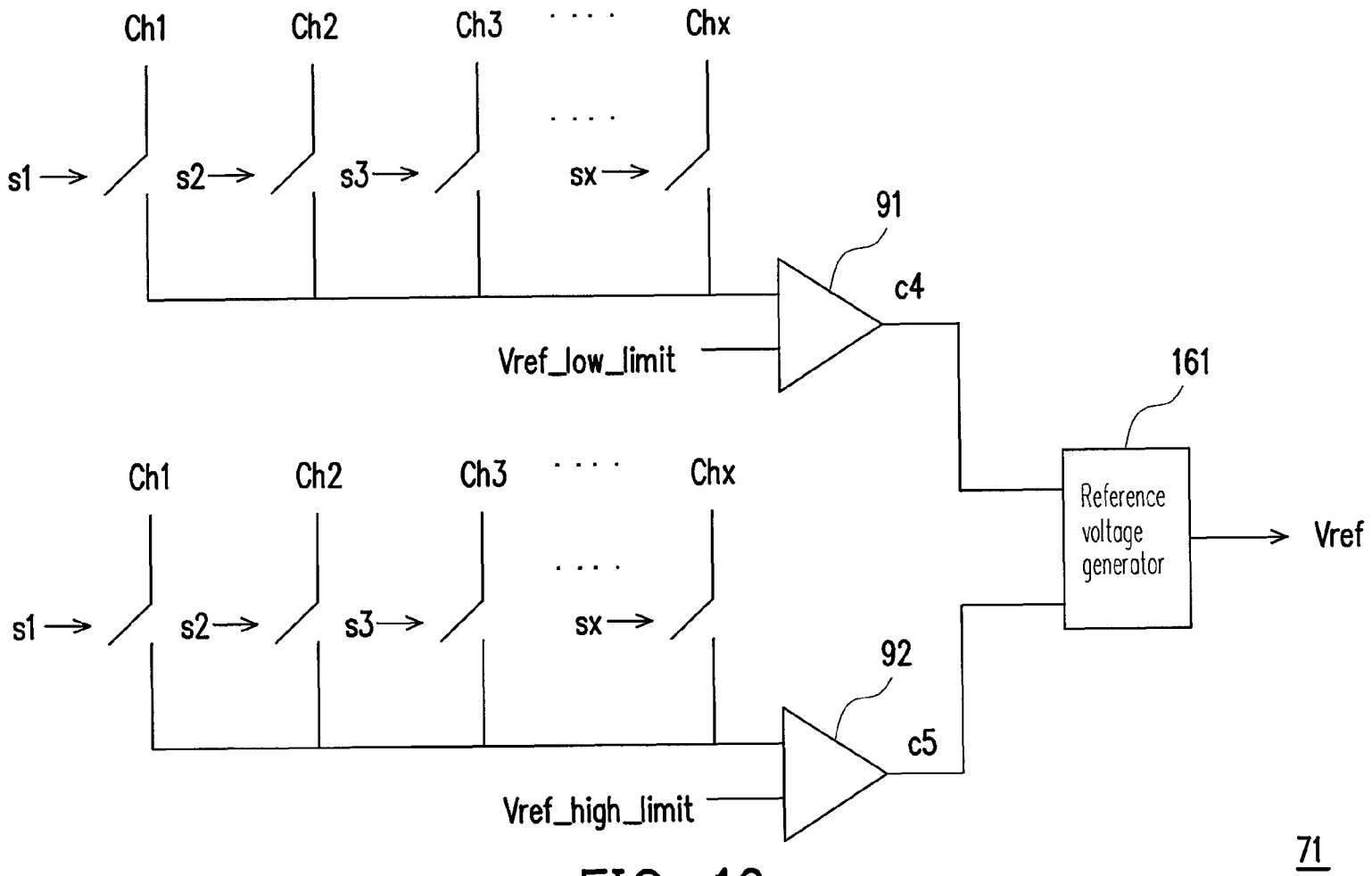
FIG. 10 is a diagram of the detecting circuit of FIG. 9.

The controlling circuit of the first embodiment is one of the implementations only, and anyone skilled in the art may modify the above-mentioned implementation of the controlling circuit and appropriately adjust the circuit architecture depending on the requirement. For example, FIG. 9 is a diagram of a controlling circuit according to the second embodiment of the present invention and FIG. 10 is a diagram of the detecting circuit of FIG. 9. Referring to FIGS. 9 and 10, the second embodiment is similar to the first embodiment except that the controlling circuit of the second embodiment further includes an error amplifier 121, a power supply 131, a voltage-dividing circuit 141 and a voltage-regulating capacitor 151.

The power supply 131 provides a voltage to the LED channels 21-2*x* according to the voltage Vin. The voltage-regulating capacitor 151 is for stabling the voltage. The voltage-dividing circuit 141 is composed of, for example, a plurality of resistors in series connection, so that a dividing voltage Vin' is generated according to the voltage provided by the power supply 131 and outputs the voltage Vin to the error amplifier 121. The error amplifier 121 adjusts the voltage provided by the power supply 131 according to the dividing voltage Vin' and the voltage Vref provided by the detecting circuit. In more details, the error amplifier 121 adjusts the dividing voltage Vin' to approach the voltage Vref. It should be noted that the detecting circuit 71 in the second embodiment is for detecting and deciding whether or not the voltages Ch1-CHx at the cathodes of the LED channels 21-2*x* are normal. Once an abnormal voltage is revealed by the detecting circuit 71, the voltage provided by the power supply 131 may be changed by altering the voltage Vref.

Differently from the first embodiment, the detecting circuit 71 of the embodiment further includes a reference voltage generator 161. The comparator 91 respectively compares the voltages Ch1-CHx with the voltage Vref_low_limit one by one, so as to output a comparison result c4 to the reference voltage generator 161. In more details, when one of or a plurality of the voltages Ch1-CHx is lower than the voltage Vref_low_limit, it indicates the voltage or the voltages is abnormal, and the reference voltage generator 161 would accordingly increase the value of the voltage Vref according to the comparison result c4, for example, the voltage Vref may be increased by selecting a set of voltages with higher values as the voltage Vref from a plurality of sets of voltages.

On the other hand, the comparator 92 respectively compares the voltages Ch1-CHx with the voltage Vref_high_limit one by one, so as to output a comparison result c5 to the reference voltage generator 161. In more details, when one of or a plurality of the voltages Ch1-CHx is higher than the voltage Vref_high_limit, it indicates the voltage or the voltages is abnormal, and the reference voltage generator 161 would accordingly reduce the value of the voltage Vref according to the comparison result c5, for example, the voltage Vref may be reduced by selecting a set of voltages with lower values as the voltage Vref from a plurality of sets of voltages.

Figure 11:
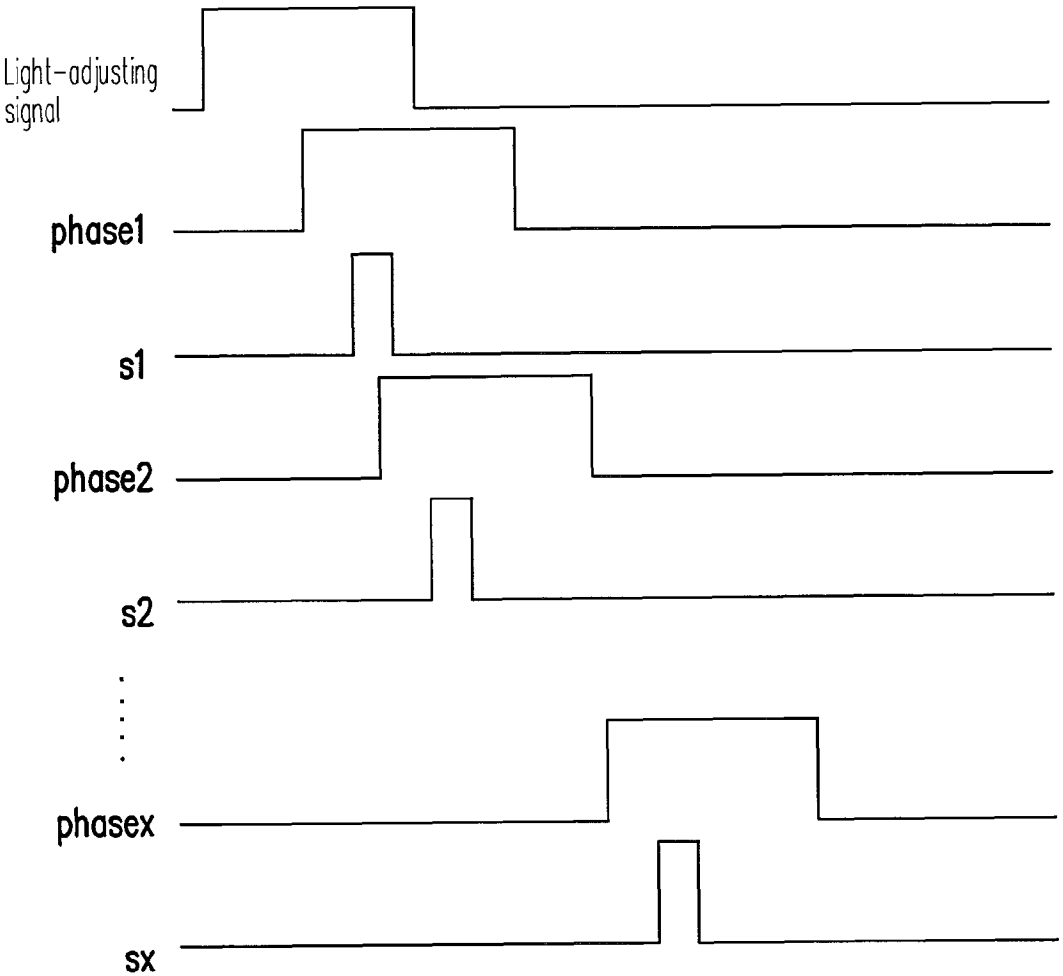
FIG. 11 is a diagram showing the timing of a light-adjusting signal and a plurality of switching signals according to the second embodiment of the present invention.

The second embodiment further provides another implementation of the signal generator. FIG. 11 is a diagram showing the timing of a light-adjusting signal and a plurality of switching signals according to the second embodiment of the present invention. In the embodiment, the signal generator 81 generates the switching signals s1-*sx* and a plurality of signals phase1-phasex, wherein the signals phase1-phasex respectively control the luminance of the LED channels 21-2*x* and the signals phase1-phasex are respectively asserted when the switching signals s1-*sx* are asserted, so as to reduce a misjudgement risk by the detecting circuit 71.

Figure 12:
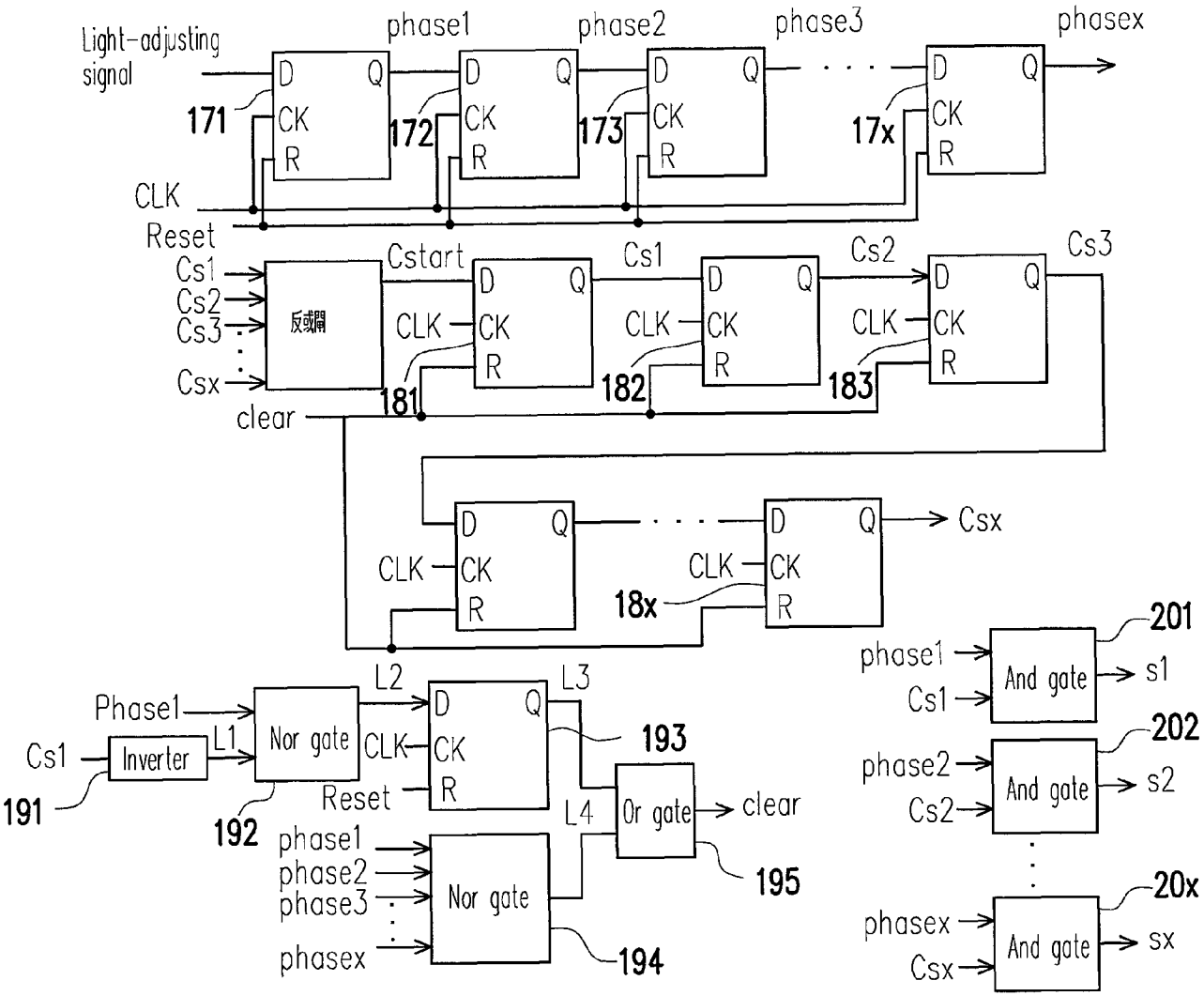
FIG. 12 is a circuit diagram of a signal generator according to the second embodiment of the present invention.

FIG. 12 is a circuit diagram of a signal generator according to the second embodiment of the present invention. In the embodiment, the signal generator 81 includes a plurality of flip-flops 171-17*x* and 181-18*x*, a plurality of NOR gates 180, 192 and 194, an inverter 191, an OR gate 195 and a plurality of AND gates 201-20*x*. The flip-flops 171-17*x* receive a signal CLK as the clock signal and a signal Reset as the reset signal. The flip-flop 171 receives a light-adjusting signal so as to output the signal phase1. The flip-flop 172 receives the signal phase1 so as to output the signal phase2. Analogically for the flip-flops 173-17*x*, which are omitted to describe.

The flip-flops 181-18*x* receive the signal CLK as the clock signal and the signal clear as the reset signal. The NOR gate 180 receives a plurality of signals Cs1-Csx so as to output a signal Cstart. The flip-flop 182 receives the signal Cstart so as to output the signal Cs1. The flip-flop 182 receives the signal Cs1 so as to output the signal Cs2. Analogically for the flip-flops 183-18*x*, which are omitted to describe.

The flip-flop 193 receives the signal CLK as the clock signal and the signal Reset as the reset signal. The inverter 191 receives the signal Cs1 and outputs a signal L1. The NOR gate 192 receives the signal phase1 and the signal L1 so as to output a signal L2. The flip-flop 193 receives the signal L2 so as to output a signal L3. The NOR gate 194 receives the signals phase1-phasex so as to output a signal L4. The OR gate 195 receives the signals L3 and L4 so as to output the signal clear.

The AND gate 201 receives the signals phase1 and Cs1 so as to output the switching signal s1. The AND gate 202 receives the signals phase2 and Cs2 so as to output the switching signal s2. Analogically for the AND gates 203-20*x*, which are omitted to describe. In this way, the embodiment not only generates the switching signals s1-*sx*, but also ensures to respectively enable the signals phase1-phasex under the condition of respectively enabling the switching signals s1-*sx*, which is advantageous in reducing a misjudgement risk by the detecting circuit 70.

In summary, the present invention takes a scheme, which respectively and alternately monitors the voltage at a terminal of one of a plurality of LED channels. In this way, the present invention may monitor whether or not the LED channels are abnormal and reduce the hardware cost (for example, reducing the quantity of the comparators). In addition, the embodiments of the present invention has following advantages:

1. The embodiments may detect out whether or not the LED channels have short-circuit, open-circuit, excessive voltage or too low voltage by changing the reference voltage of the comparator (i.e., by providing an appropriate reference voltage to the comparator).
2. The embodiments may further analyze and identify which one of the LED channels is abnormal by disposing a logic circuit at the output terminal of the comparator in association with the timing of the switching signals.
3. The hardware cost may be further reduced by using the switches to select one of the reference voltages and inputting the selected reference voltage to the input terminal of the comparator.
4. When the voltage of an LED channel gets abnormal, a feedback mechanism may be used to adjust the voltage provided to the defective LED channel.
5. When the light-adjusting signal is asserted, a misjudgement risk may be reduced by monitoring the voltage at a terminal of each of the LED channels.

It will be apparent to those skilled in the art that various modifications and variations can be made to the structure of the present invention without departing from the scope or spirit of the invention. In view of the foregoing, it is intended that the present invention covers modifications and variations of this invention provided they fall within the scope of the following claims and their equivalents.

What is claimed is:

1. A controlling circuit, comprising:

a plurality of first switches, having a first terminal and a second terminal for each of the first switches, wherein the first terminals are respectively coupled to one of a plurality of light emitting diode strings, the first switches are conducted according to a plurality of first switching signals respectively, and the first switching signals are asserted alternately;

a comparator, having a first input terminal and a second input terminal, wherein the first input terminal is coupled to the second terminals of the first switches and the second input terminal of the comparator receives a first reference voltage, for comparing the voltage of the first input terminal with the voltage of the second input terminal so as to output a comparison result; and a reference voltage generator, coupled to the comparator and outputting a second reference voltage according to the comparison result;

an error amplifier, coupled to the reference voltage generator and receiving the second reference voltage and a dividing voltage so as to output an adjusting signal;

a power supply, coupled to the error amplifier and the light emitting diode channels, adjusting a supply voltage according to the adjusting signal and outputting the supply voltage to the light emitting diode channels;

a voltage-dividing circuit, coupled to the power supply and the error amplifier and generating the dividing voltage according to the supply voltage; and a voltage-regulating capacitor, coupled to the power supply.

2. The controlling circuit as claimed in claim 1, further comprising:

a signal generator, coupled to the first switches, for generating the first switching signals.

3. The controlling circuit as claimed in claim 2, wherein the signal generator comprises:

an NOR gate, receiving the first switching signals to generate a trigger signal; and a flip-flop string, receiving the trigger signal to generate the first switching signals.

4. The controlling circuit as claimed in claim 1, further comprising:

a logic circuit, comprising:

a flip-flop string, comprising a plurality of flip-flops, wherein an input terminal of each of the flip-flops receives the comparison result, the flip-flops respectively receive the first switching signals to generate a plurality of indication signals respectively, and the first switching signal serves as a clock signal of the corresponding flip-flop.

5. The controlling circuit as claimed in claim 4, wherein the logic circuit further comprises:

an OR gate, receiving the indication signals to generate an output signal.

6. The controlling circuit as claimed in claim 1, further comprising:

an alert device, coupled to the comparator and deciding whether or not to send out an alert according to the comparison result.

7. A controlling circuit, comprising:

a plurality of first switches, having a first terminal and a second terminal for each of the first switches, wherein the first terminals are respectively coupled to one of a plurality of light emitting diode strings, the first switches are conducted according to a plurality of first switching signals respectively, and the first switching signals are asserted alternately;

a comparator, having a first input terminal and a second input terminal, wherein the first input terminal is coupled to the second terminals of the first switches and the second input terminal of the comparator receives a first reference voltage, for comparing the voltage of the first input terminal with the voltage of the second input terminal so as to output a comparison result;

a plurality of second switches, having a first terminal and a second terminal for each of the second switches, wherein the first terminals are respectively coupled to one of a plurality of voltages, the second terminals are coupled to the second input terminal of the comparator, the second switches are conducted according to a plurality of second switching signals respectively so as to select one of the voltages as the first reference voltage, and the second switching signals are asserted alternately.

8. The controlling circuit as claimed in claim 1, further comprising:

a plurality of current sources, respectively connecting in series one of the light emitting diode channels and respectively controlling the current flow each of the light emitting diode channels according to one of a plurality of light-adjusting signals.

9. The controlling circuit as claimed in claim 8, further comprising:

a signal generator, comprising:

a first NOR gate, receiving a plurality of filtering signals to generate a trigger signal;

a first flip-flop string, receiving the trigger signal to generate the filtering signals;

a second flip-flop string, receiving a reference light-adjusting signal to generate the light-adjusting signals;

a plurality of AND gates, having a first terminal and a second terminal for each of the AND gates, wherein the first terminals respectively receive one of the filtering signals, and the second terminals respectively receive a corresponding light-adjusting signal so as to generate each of the first switching signals;

an inverter, receiving a first filtering signal in the filtering signals;

a second NOR gate, having a first input terminal, a second input terminal and an output terminal, wherein the first input terminal receives a first light-adjusting signal in the light-adjusting signals and the second input terminal is coupled to the output terminal of the inverter;

a flip-flop, having an input terminal and an output terminal, wherein the input terminal is coupled to the output terminal of the second NOR gate;

a third NOR gate, receiving the light-adjusting signals; and an OR gate, having a first input terminal and a second input terminal, wherein the first input terminal and the second input terminal are respectively coupled to the output terminal of the flip-flop and the output terminal of the third NOR gate so as to output a reset signal to the first flip-flop string.

* * * * *